United States Patent [19]

Kuck et al.

[11] 4,217,184

[45] Aug. 12, 1980

[54] CONTINUOUS PROCESS FOR PREPARING METAL ALKOXIDES

[75] Inventors: Mark A. Kuck, Upper Montclair, N.J.; Gary K. Miller, Port Chester, N.Y.

[73] Assignee: Stauffer Chemical Company, Westport, Conn.

[21] Appl. No.: 23,985

[22] Filed: Mar. 26, 1979

[51] Int. Cl.[2] ..... C25B 3/12; C25B 15/08

[52] U.S. Cl. ..... 204/59 QM; 204/237; 204/239

[58] Field of Search ..... 204/59 R, 59 QM

[56] References Cited

U.S. PATENT DOCUMENTS

| | | | |
|---|---|---|---|
| 2,438,963 | 4/1948 | Cunningham et al. | 204/72 |
| 3,730,857 | 5/1973 | Tripp | 204/59 R |
| 3,964,983 | 6/1976 | Eisenbach et al. | 204/59 L |

*Primary Examiner*—F. C. Edmundson

*Attorney, Agent, or Firm*—Henry Z. Friedlander

[57] ABSTRACT

A continuous process for the electrochemical production of insoluble metal alkoxides comprises the steps of continuously removing the slurry of electrolyte and product from the cell, separating the product from the electrolyte, and returning the clarified electrolyte to the cell.

8 Claims, 1 Drawing Figure

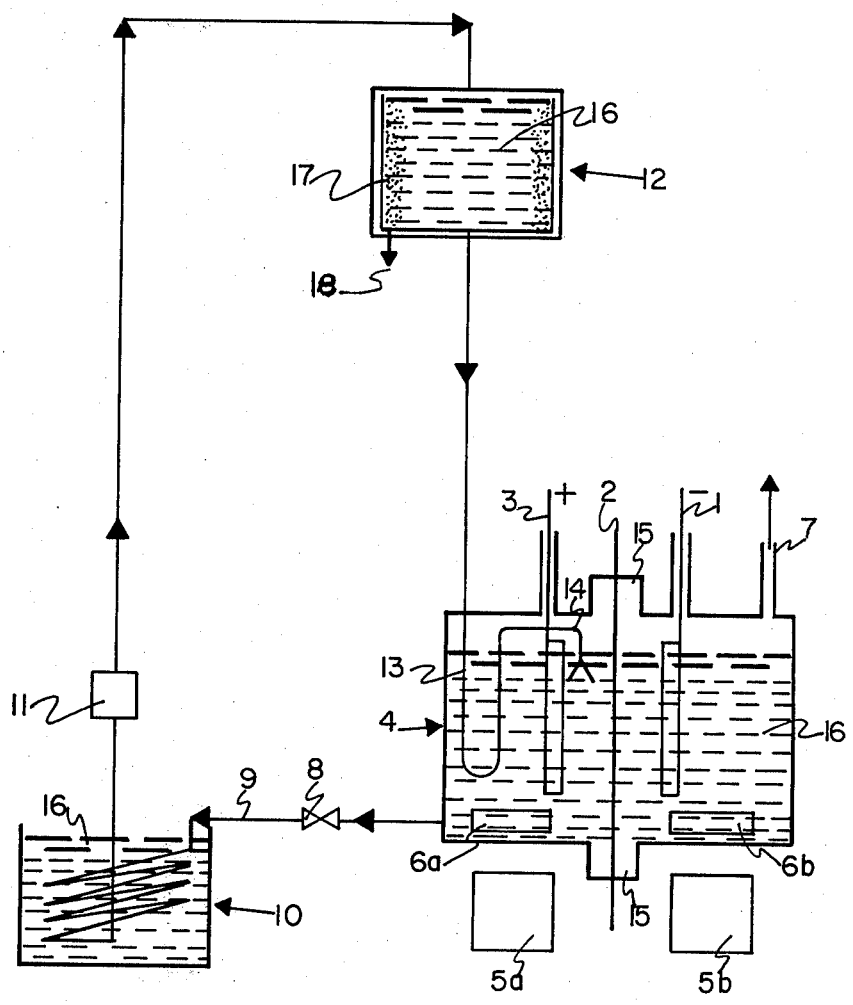
FIGURE

CONTINUOUS PROCESS FOR PREPARING METAL ALKOXIDES

BACKGROUND OF THE INVENTION

1. Field of the Invention

This invention relates to the continuous operation of electrochemical cells. More particularly it relates to continuous operation of electrochemical cells which produce a particulate product substantially insoluble in the electrolyte in which it is formed. The process is especially useful for the continuous operation of an electrochemical cell, when a slurry is formed in only one side of the cell. The process of this invention is especially adaptable to the continuous electrochemical preparation of metal alkoxides in the anodic compartment of a separated cell.

The process of this invention is particularly useful for preparing antimony glyoxide. When an electrochemical cell is used for that purpose, the anode is a sacrificial one made from antimony. Ethylene glycol is the reactive medium for the conducting electrolyte. If an effective separator is employed, the antimony cations are confined to the anolyte, glyoxide anions migrate from the catholyte to the anolyte, and a slurry of antimony glyoxide product forms in the anode compartment.

When the product of an electrochemical synthesis is insoluble in the electrolyte, it is difficult to operate the cell continuously. Particulate product coats the electrode and the separator thus raising electrical resistance and lowering current density. The process must be halted periodically to clean the electrodes, separators, cell, agitators, and exit valves. If an attempt is made to circulate the electrolyte continuously, pumps, flow meters, valves, and pipes or tubes get clogged with precipitate. In such a situation cleaning is laborious and the yield of product falls because of waste. If aliquots are removed periodically to isolate the insoluble product, they must be filtered and the filter cake washed free of electrolyte. As a result of such filtration either electrolyte is continuously wasted or becomes diluted with unwanted wash liquid. Intermittent filtration increases labor, raises chemical losses, and increases wear by tolerating medium to high levels of dispersed solids throughout the equipment.

The process of this invention solves many of the problems commonly associated with running an electrochemical process continuously, when the product is insoluble in the electrolyte. Metal alkoxides in general and antimony glyoxide specifically are examples of such insoluble products. Surprisingly, yield is increased, current density is maintained, and the cell is kept clean during continuous operation.

2. Description of the Prior Art

Applicants know of no prior art directly relating to the process of this invention.

A process for the production of tetraethyl lead is described in U.S. Pat. No. 3,069,334 granted to Ziegler et al on Dec. 18, 1962. The process of Ziegler et al employs a cellulosic or glass fiber diaphragm to separate an anolyte and a catholyte of different chemical composition relating to the production of an intermediate, aluminum trimethyl. Both anolyte and catholyte liquids are continuously circulated to and from separate storage vessels. In the catholyte circuit aluminum, an intermediate by-product/component of the intermediate aluminum triethyl, is separated from a complex aluminum triethyl-sodium fluoride by a settling tower.

In another embodiment disclosed by Ziegler et al two immiscible liquid intermediates in the anolyte circuit are continuously passed through a counter-current extraction centrifuge after cooling in order to remove the heavier liquid, molten lead.

3. Objects of the Invention

The principal object of the instant invention is to provide a process to operate continuously electrochemical cells which produce an insoluble, particulate product. Another object of the invention is to provide a process for producing metal alkoxides continuously, e.g. antimony ethyleneglyoxide. A further object of the invention is to provide a method to remove insoluble product from an electrochemical process, which generates a slurry in the electrolyte. Still a further object of the invention is to keep electrochemical cells clean and electrodes and separators free of particulate deposits, so that electrical resistance is minimized. Another object of the invention is to maximize chemical yield from a continuously run electrochemical cell producing particulate products, especially metal alkoxides. Yet another object of the process of this invention is to decrease the labor in producing metal alkoxides continuously. Other objects will be apparent to those skilled in the art from the description and examples which follow, as well as by inspection of the Figure.

SUMMARY OF THE INVENTION

The process of the instant invention is a continuous electrochemical method for the production of particulate compounds insoluble in the electrolyte of the electrochemical cell. It is particularly adaptable to the continuous manufacture of metal alkoxides. The process compirses the steps of drawing a slurry from an electrochemical cell, separating the particulate product from the electrolyte preferably by means of a continuous centrifuge, and circulating the clarified electrolyte back to the cell.

Optionally, one may chill the slurry to precipitate more product from the electrolytic solution before separation and heat the clarified electrolyte to clear it further before returning it to the cell. Furthermore, one may direct the warm cleansing stream from the reentry port onto the cell membrane and/or electrode in order to wash them free of deposits.

BRIEF DESCRIPTION OF THE DRAWING

The Figure illustrates an embodiment of the present invention in diagrammatic form.

DETAILED DESCRIPTION OF THE INVENTION

In order to operate an electrochemical cell continuously with the electrolyte in the form of a slurry it is necessary to carry out several functions or the operation becomes drastically imparied. This is particularly true in the case of the production of metal alkoxides because elemental metal may contaminate the metal alkoxide. For this reason a discriminating membrane between the anolyte and the catholyte compartments is useful. The use of such a membrane is the subject of the copending application, Ser. No. 023,937, filed on the same day as this application, the specification of which is incorporated herein by reference.

The process of this invention may be carried out so that the membrane and electrodes are kept free of deposits of metal alkoxide and the electrical resistance maintained relatively uniform. In a batch process this is accomplished either manually or mechanically. In the present invention it is accomplished by removing the precipitate as it forms. Optionally, one may rinse the electrode and membrane with the returning clarified stream.

In the production of metal alkoxides the anode is the source of metal, hence it is called a "sacrificial" anode. For making antimony ethyleneglyoxide the anode is antimony.

The ideal membrane keeps the antimony ions in the anolyte so that no antimony metal is formed by reduction at the cathode. An anion-exchange membrane is highly preferred, since it allows glyoxide ions to pass into the anolyte from the catholyte. The slurry of antimony glyoxide forms therefore in the anode compartment. If deposits form in both compartments of a cell, this invention may be carried out on both the anolyte and catholyte. In the ordinary practice of making metal alkoxides, only the anolyte stream requires processing.

During the course of the electrolysis agitation is used to prevent polarization. This may be accomplished by means of magnetic stirrers, rotary stirrers, rotating electrodes, vibrating electrodes, circulation of the electrolyte or combinations of these means of agitation.

In order to increase the yield of metal alkoxides, which are soluble in the alcoholic electrolyte to varying extents, the electrolyte may be cooled. Cooling causes more precipitate to form. The electrolysis process warms the cell by resistance heating, therefore cooling the electrolyte outside of the cell increases the amount of recoverable product. Cooling is optional, however, and is not necessary for the practice of the invention.

A pump of the centrifugal or Moyno type is preferred for circulating the slurry through the system, but any suitable pumping means may be employed.

The conduits and connections for transporting the slurry through the separation system may be of any convenient inert material. Glass, stainless steel, or plastic conduits may be employed of which plastic is preferred. If plasticized plastic tubing is used, the plasticizer should be leached out by the alcoholic medium such as ethylene glycol.

Separation of the precipitated deposits of metal alkoxide from the alcoholic, electrolytic medium is an important step in the instant invention. Separation accomplished both isolation of the product, such as antimony glyoxide, and freeing the valves, pumps, flowmeters, and conduits of clogging deposits. Filters, especially in tandem so they may be cleaned, centrifuges, cyclones, or magnetic separators for paramagnetic precipitates may be used. Continuous centrifuges are preferred separating means for carrying out the invention. Filters are also effective in performing the separation.

As an optional step in the process of the invention the clarified electrolyte is heated before return to the electrolysis cell. One method for carrying this out is by using the heat generated by electrical resistance of the cell itself. The warm electrolyte has greater rinsing, cleaning, and solubilizing power for washing down any deposits in the cell upon reentry. It is advantageous to direct reentry of the warmed, clarified electrolyte onto the surface of the membrane, or the electrode, or both because these are the portions of the cell where the accumulation of precipitate affects electrical resistance. The reentry port may be narrowed into a nozzle to increase the force of the returning, cleansing stream. The reentry port may rotate or oscillate in order to play upon the membrane and one or more electrodes. Alternatively, the returning liquid may be dispersed by a horizontal or vertical member bearing a plurality of orifices to direct the stream onto the membrane or electrode surfaces.

The conducting component for the alcoholic medium is normally an inorganic or organic salt, soluble in the alcohol.

In addition to its solubility in the fluid medium, the conducting salt should be inert electrochemically to both the anode and the cathode. Tetramethylammonium chloride is a preferred example. Lithium perchlorate may be used with caution. Another type is electrolyte is represented by tetrabutylammonium fluoroborate. The concentration of electrolyte can be varied from about $0.5\times10^{-4}$ to about $10^{-2}$ molar. The concentration is not critical to the synthesis of metal alkoxides. The current density passing in the cell depends on the voltage impressed, the spacing and area of the electrodes, the nature and thickness of the separating membrane, and the concentration of electrolyte.

The alcohol, itself, should be reactive enough to generate alkoxide ions at the cathode, glyoxide ions for glycols. It is the alkoxide anions which permeate the separator to form metal alkoxide in the anolyte compartment.

The size of the particles of alkoxide depends on many variables. Among these are the current density, the recirculation rate, the cleansing action of the reentry stream, and the temperature of the cell. The size distribution for any set of parameters will vary also. Almost all particles are found to be below 100 micrometers in size, usually averaging below 40 microns. Typically the average in the distribution of particles ranges from about 2 to about 15 microns. The invention, however, is not limited to any particular range of particle size.

The FIGURE represents a diagrammatic embodiment of the process of the instant invention. The cathode 1 for the purpose of making metal alkoxides is an indifferent electrode. Any practical conductor such as aluminum, carbon, or mild steel may be used. The prerequisites are that it be inert to alcohols, glycols and conducting salts yet enable alkoxide or glyoxide ions to form without unusual polarizations, overvoltages, or side reactions. The preferred material for the cathode is aluminum.

The separating membrane 2 is preferably an anion-exchange membrane with a permselectivity for anions as compared to cations of at least 70 percent, more preferably of greater than 90 percent. Permselectivity of 100 percent is an ideal concept, the theoretical value from the Nernst equation for the perfect discriminating ion-exchange membrane. The thinner the anion-exchange membrane the lower its electrical resistance for a given ion-exchange capacity, but the less resistant it is to mechanical damage and wear. Membranes of about 1 to about 2 mm thickness are preferred. Anode 3 is preferably a sacrificial electrode made up of the metal of the alkoxide, e.g. antimony for antimony glyoxide. Copper, bismuth, silver, palladium, or gold anodes may be employed to make their respective alkoxides. Electrochemical cell 4 is a vessel constructed of inert material such as glass, rubber-coated steel, stone, concrete, wood, or ceramics. The cell is held together in use by an O-ring or gasket at joint 15. A continuous seal is thus provided tight enough to prevent leakage of the electrolyte, but not so tight to crack or abrade the separating membrane. Stirring motors **5*a* and 5*b* drive stirring bars 6a and 6b magnetically, one in each compartment of the cell. Alternatively, other types of agitation such as direct stirring blades may be used. Vent 7** allows for the escape and collection of hydrogen gas normally generated at the cathode during the formation of alkoxides from alcohols and glyoxides from glycols.

Valve 8 permits drainage of the electrolyte 16 from the electrochemical cell 4 into the heat exchanger 10 by means of exit line 9. When valve 8 is closed the cell may be run in batch fashion rather than in the continuous manner of the instant invention. Heat Exchanger 10 cools the electrolyte increasing the amount of metal alkoxide precipitated as slurry. Pump 11 circulates the electrolyte through the system.

A continuous centrifuge 12 is the preferred separating means for separating the metal alkoxide 17 from the electrolyte 16. Other separating means which may be used for unit 12 are cyclones, filter beds, filter presses, or magnetic separators. The product is withdrawn at collector means 18.

The filtrate heat-exchange loop 13 warms the cold, clarified filtrate. The electrolytic cell normally is at a higher temperature than ambient because of the electrical resistance of the cell. Electrical energy flowing from a power source, not shown, to the electrodes is converted to heat by the electrochemical process. Heat exchanger 10 lowers the temperature of the slurry to ambient or below, that is to about 0° to about 40° C. Heat exchanger 13 raises the temperature of the clarified filtrate to about 15° to about 55° C., the temperature of the operating cell.

The warm, clarified filtrate reenters the cell through reentry port 14. The reentry port 14 is fashioned with a plurality of adjustable members, normally two. One inlet directs the warm, clarified filtrate against the separating membrane rinsing it free of deposits of precipitated metal alkoxide. The other inlet directs the warm, clarified filtrate against the anode cleansing it of precipitated product. This rinsing action has at least three beneficial effects. Firstly, cleaning the membrane and the anode decreases the electrical resistance of the cell, minimizes waste heat, and increases electrical efficiency. Secondly, freeing the cell of deposits raises the chemical efficiency of the electrolysis. That is—overvoltage is reduced and the production of by-products is minimized. Finally, washing deposits into the bottom of the cell lowers the residence time of the particulate product in the system and lengthens the time of each run between shutdowns for cleaning.

The two compartments of the cell contact the separating membrane at the continuous seal 15. This seal may be an O-ring, or a gasket. It functions to hold the cell to the membrane without allowing electrolyte to leak out or causing the membrane to crack.

The electrolyte 16 normally consists of two components: the liquid alcohol necessary for reaction to form alkoxides and a soluble salt to make the solution a conductor of electricity. The salt must be one soluble in the anhydrous alcohol or glycol being employed such as tetramethylammonium chloride or tetrabutylammonium fluoroborate.

Particulate product 17 is separated from the electrolytic solution by separating means 12, normally a continuous centrifuge. Depending on the current density, the recirculation rate, the cleansing action of the reentry stream from reentry ports 14, and the temperature, these particles vary in size from about 2 to about 20 micrometers.

The following examples illustrate the utility and best mode of practicing the process of this invention, but should not be interpreted as limiting its scope.

EXAMPLE 1

This example illustrates the use of an inline filter as the separating means, 12 of the FIGURE.

The electrolytic cell was constructed of dual, in-line, cylindrical glass flanges 10 cm in diameter. Each was fitted with a stirring bar, stirring motor, and nitrogen inlet. A circular disc of 99.99 percent antimony, 9.2 cm in diameter and 0.5 cm thick served as the anode; it was covered with electrolyte to about 7 cm. A circular disc of mild steel, 9.2 cm in diameter and 0.5 cm thick served as the cathode. Anion-exchange membrane 103 QZL-219 from the Ionics Co. (Watertown, Mass.) served as the selective separator. The electrolyte strength was 2.0 g dry tetramethylammonium chloride per 100 ml of dry ethylene glycol. Of this solution 550 ml was used for the anolyte; 400 ml for the catholyte.

The circulating system was composed of 8 mm I.D. vinyl tubing connecting a 1 cm Whitey Co. metering valve, a circular, glass coil, ½-meter long chilling heat exchanger in a cold water bath, temperature 16° C., a Cole-Palmer magnetic drive centrifugal pump Model 7004-60, a Matheson Co. Model 604 flowmeter, and an in-line filter 7 cm in diameter comprising Whatman No. 50 filter paper, polypropylene woven cloth, 100 mesh, backed by a metal screen support.

As power 11 v of direct voltage was impressed across the cell for 20 hours leading to a current of 0.35 amperes. During this time the circulation rate was 90 ml/min. For an additional 7.5 hours about 35 ml/min of electrolyte was circulated with a current flow of 0.42 amperes. For an additional 16.5 hours flow was less than 5 ml/min at 0.17 amperes due to plugging in the pump.

During the entire reaction the antimony anode lost 51.1 g of weight. The antimony glycolate was separated, washed with acetone, and weighed 12.5 g. Upon elemental analysis it was found to be 56.8 percent antimony (calculated valve for antimony glyoxide 57.5 percent).

EXAMPLE 2

Example 2 illustrates the improvement in freedom from plugging the pump, flowmeter, valve, lines, and electrolytic cell parts resulting from substituting a continuous centrifuge for the in-line filter of Example 1.

The same equipment was used as in Example 1 except that a Janke and Kunkel A.G., Model F-10, 6000 rpm, porcelain-jacketed continuous centrifuge was installed in place of the filter. This centrifuge is manufactured at Staufen-im-Breisgau (West Germany). The centrifuge was fitted with Janke and Kunkel medium porosity filter paper. The centrifuge was housed in a plastic film chamber under dry nitrogen gas to ensure that no water vapor entered the system.

For 31 hours 17 volts was impressed across the cell. The anode of 99.99 percent antimony lost 53.5 g. Current flow was about 0.55 amperes. A sample of antimony glyoxide was taken from the centrifuge filter paper. After washing with acetone and filtering, it weighed 14.9 g and had an antimony content of 56.5 percent (Calculated for antimony glyoxide 57.5 percent). The particle size of this product was about 15 microns in diameter.

The foregoing examples illustrate the utility of the instant invention. The scope of legal protection sought for this invention is set forth below.

What is claimed is:

1. In a process for the production of a metal alkoxide in an electrochemical cell fitted with a membrane separator between anolyte and catholyte by passing electrical current through an alcoholic electrolyte between a sacrificial anode and a cathode, wherein the metal alkoxide is precipitated from the electrolyte, the improvement comprising the steps of:

(a) continuously removing a slurry of solid metal alkoxide and alcoholic liquid electrolyte from the cell;

(b) separating solid metal alkoxide from the alcoholic liquid electrolyte; and (c) returning the clarified alcoholic liquid electrolyte back to the electrochemical cell.

2. The process of claim 1, wherein the anode is antimony.

3. The process of claim 1, wherein the alcohol is ethylene glycol.

4. The process of claim 1, wherein the separating means is a filter.

5. The process of claim 1, wherein the separating means is a centrifuge.

6. The process of claim wherein the clarified alcoholic liquid electrolyte returning to the cell is directed so as to rinse the membrane separator, the anode or both the separator and the anode.

7. In a process as described in claim 1 the additional step of cooling the slurry so as to increase the amount of precipitated metal alkoxides.

8. In a process as described in claim 1 the additional step of heating the clarified electrolytic liquid so as to increase its solubilizing power.

* * * * *

UNITED STATES PATENT AND TRADEMARK OFFICE

CERTIFICATE OF CORRECTION

PATENT NO. : 4,217,184

DATED : August 12, 1980

INVENTOR(S) : Mark A. Kuck and Gary K. Miller

It is certified that error appears in the above-identified patent and that said Letters Patent are hereby corrected as shown below:

Col. 2, line 35 - "compirses" should be -- comprises --.

Col. 2, line 57 - "imparied" should be -- impaired --.

Col. 3, line 42 - "should be leached" should be -- should not be leached --.

Col. 3, line 47 - "accomplished" should be -- accomplishes --.

Col. 8, line 9 - "claim" should be -- claim 1 --.

Signed and Sealed this

*Third* Day of *February 1981*

[SEAL]

*Attest:*

RENE D. TEGTMEYER

*Attesting Officer*

*Acting Commissioner of Patents and Trademarks*